US005901867A

United States Patent [19]

Mattson

[11] Patent Number: 5,901,867

[45] **Date of Patent: *May 11, 1999**

[54] VENTABLE CAP

[75] Inventor: Larry J. Mattson, Charlotte, N.C.

[73] Assignee: Roberts PolyPro, Inc., Charlotte, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/881,624

[22] Filed: Jun. 24, 1997

Related U.S. Application Data

[63] Continuation of application No. 08/548,010, Oct. 25, 1995, abandoned.

[51] Int. Cl.[6] ..... B65D 51/16; B65D 53/00

[52] U.S. Cl. ..... 215/261; 215/308; 215/329; 215/902

[58] Field of Search ..... 215/307, 308, 215/248, 261, 310, 329, 902; 220/303, 367.1, 371, 372, 373, 374, 369, 370, 745, 913, 521

[56] References Cited

U.S. PATENT DOCUMENTS

| | | | |
|---|---|---|---|
| 234,342 | 11/1880 | Stewart | 215/307 |
| 281,608 | 7/1883 | Browne | 220/373 X |
| 719,184 | 1/1903 | Campbell | 215/307 |
| 728,426 | 5/1903 | Timar | 215/308 |
| 1,020,077 | 3/1912 | Bowser | 220/372 X |
| 1,340,830 | 5/1920 | Jenkins | 220/373 X |
| 1,499,461 | 7/1924 | Kruppa | 220/374 |
| 2,298,938 | 10/1942 | Griffin, Jr. et al. . | |
| 2,329,078 | 9/1943 | O'Daniel | 220/374 |
| 3,083,861 | 4/1963 | Amberg et al. | 220/371 |
| 3,448,882 | 6/1969 | Roy . | |
| 3,941,270 | 3/1976 | Spielman | 215/261 |
| 3,951,293 | 4/1976 | Schulz . | |
| 3,954,623 | 5/1976 | Hammer et al. | 215/261 X |
| 4,545,498 | 10/1985 | Schmid . | |
| 4,584,182 | 4/1986 | Sanderson et al. | 220/371 X |
| 4,596,338 | 6/1986 | Yousif | 215/261 X |
| 4,765,499 | 8/1988 | Von Reiss et al. . | |
| 4,863,051 | 9/1989 | Eibner et al. . | |
| 5,176,271 | 1/1993 | Painchaud et al. . | |
| 5,180,073 | 1/1993 | Fay et al. . | |
| 5,515,994 | 5/1996 | Goglio | 220/372 |

FOREIGN PATENT DOCUMENTS

| | | | |
|---|---|---|---|
| 1200415 | 12/1959 | France | 215/307 |
| 5654 | 3/1904 | United Kingdom | 215/307 |

*Primary Examiner*—Stephen Castellano
*Assistant Examiner*—Niki M. Eloshway
*Attorney, Agent, or Firm*—Hardaway Law Firm, PA

[57] ABSTRACT

A vented closure is provided in which a PTFE membrane layer comprises a vent for releasing accumulated gas pressure. The membrane is carried on a structural support which may vary from a fabric type backing to a porous plastic stem, the support permitting a variety of improved vent architecture to be utilized including vents with reduced material requirements, improved geometry, and better handling characteristics.

17 Claims, 2 Drawing Sheets

VENTABLE CAP

This application is a continuation of application Ser. No. 07/548,010, filed Oct. 25, 1995, now abandoned.

BACKGROUND OF THE INVENTION

This invention is directed towards providing a self-venting cap for releasing vapor pressure from sealed containers. Pressure can accumulate in containers from a variety of causes including gas evolving chemical reactions, de-gassing of filled contents, foaming of contents from normal shipping and handling, temperature fluctuations, attitudinal changes, as well as abnormal conditions which may result from contamination or mishandling of the containers.

There is a particular demand for venting closures for retail containers of surfactants, cleaning products, and similar fluids which tend to generate vapor pressure. As pliable, plastic containers have become more popular with consumers, vapor pressure problems have become more numerous. Such problems include failed closures, container distortion which interferes with retail displays, and consumer distrust of misshapen (pressure distorted) containers. Packaging volumes are often less efficient as product head space, the unfilled volume, is increased to compensate for pressure fluctuations.

A variety of ventable caps and containers are known in the art. Several patents exist which provide for a gas-permeable, liquid-impermeable polytetrafluorethylene (PTFE) barrier for venting vapor pressure. One such patent is U.S. Pat. No. 3,951,293 to Schulz which is incorporated herein by reference and which discloses a liquid closure having one or more horizontal film layers of PTFE as a cap liner. The liner permits communication between the container vapor pressure and the external vapor pressure through a perforated cap or sealing diaphragm. While such a closure is suitable for many applications, it has been found unsuitable for some viscous liquids. Further, the prior art designs require generous use of the PTFE material to provide sufficient venting. Therefore, there is room for variation and improvement within the art.

SUMMARY OF THE INVENTION

This invention is directed towards a novel self-venting container in which a PTFE membrane sleeve envelops an interior stem portion of a closure, thereby providing a vent. The stem defines a plurality of passages which communicate with an exterior of the cap. The membrane sleeve provides a molecular matrix of sufficient size that typical evolved gas constituents (oxygen, carbon dioxide, chlorine based gases) may pass through the membrane while the fluid/liquid product contents are barred.

The vent is positioned relative to the closure so that the stem and membrane shape and position promote the self-clearing by gravity, of materials from the membrane. The preferred embodiments permit even extremely viscous fluids to flow off the membrane surface and thereby allow gases to vent.

Alternative embodiments provide a more economical vented cap structure suitable for less viscous materials. In these embodiments the vent structure is sonically welded to the inner cap surface so that the vent membrane and supporting vent structure is placed at an angle sufficient to promote drainage of fluids from the vent structure when the container is in a normal position.

The angled placement of the vent, or portion of the vent, allows the container's fluid contents to drain from the vent, thereby facilitating the release of accumulated pressure. The location and geometry of the vent is especially useful for viscous fluids. Heretofore, traditional PTFE venting closures placed the membrane layer parallel with the closure liner or in place of a liner. For viscous materials, small vent openings are easily covered with product. If pressure builds, the pressure may keep the vent occluded, the pressure sealing the vent opening with the fluid.

In general, the smaller the vent size, the more likely the container contents are to form a droplet which seals the vent area. For reasons of economy, it is desirable to utilize as small a PTFE vent as possible. However, if too small a vent is used, even low viscosity fluids will form droplets capable of covering a vent.

In accordance with this invention it has been found that by altering the geometry of the vent, one can position or provide a vent such that fluid materials will drain from the vent surface. Further, the drainage will occur even when the container is pressurized. For many uses, this ability enables smaller vents to be used, conserving the amount of PTFE required for each closure. For highly viscous materials, a novel vent can be provided for material which here-to-for rendered conventional venting cap structures unusable.

OBJECTS OF THE INVENTION

It is an object of this invention to provide a novel gas-permeable closure cap suitable for use with high viscosity fluids.

It is a further and more particular object of this invention to provide a vent for a closure in which a gas permeable or porous support structure is used to carry a membrane barrier layer, thereby providing greater versatility in the position, handling, and size of the vent portion of the closure.

It is a further object of this invention to provide a novel gas-permeable closure cap which reduces the amount of PTFE membrane required for a venting cap.

It is still a further and more particular object of this invention to provide a vent for a closure cap, the vent being positioned within said cap so that viscous fluids will drain from vent area.

It is still a further and more particular object of this invention to provide a vent for a closure cap, the vent being positioned within said cap so that viscous fluids will drain from the vent area when the container is pressurized.

It is still a further object of this invention to provide a sonically welded vent structure for a closure which minimizes the amount of semi-permeable membrane material used in the closure.

These and other objects of the invention are provided by a gas-permeable liquid-impermeable closure comprising a cap defining a top, the top having an inner and outer surface, the top further defining an aperture traversing the top; and a vent supported within an interior of the closure and in liquid-tight communication with the aperture, the vent further comprising a gas permeable support in communication with the aperture and carrying a semi-permeable membrane.

Alternative embodiments are provided by a cap having an inner-threaded skirt and a top, the top further defining a bore traversing the top; a stem carried by an inner-surface of the top, the stem defining an axial passage along at least a portion of its length and the axial passage in communication with the bore, the stem further defining a lateral passage traversing the stem and in communication with the axial passage; and a sleeve carried by the stem, the sleeve covering the lateral passage stem openings and providing a semi-permeable barrier in communication with the passage.

DETAILED DESCRIPTION

Figure 1:
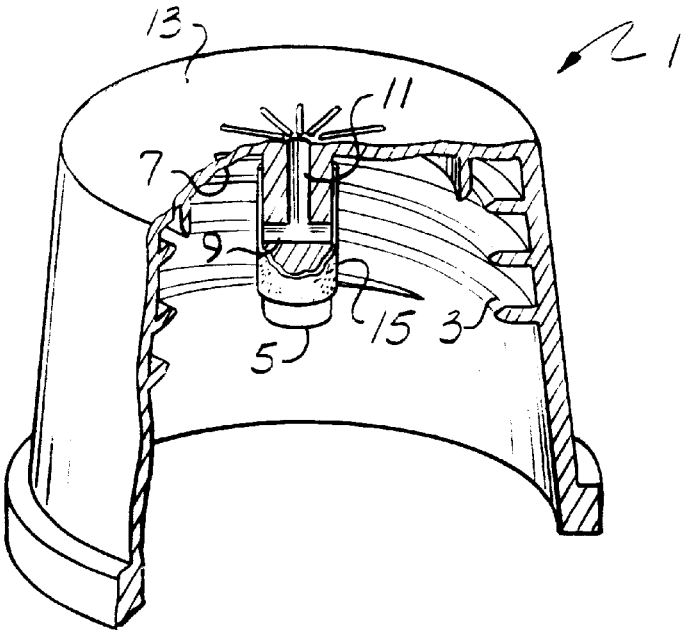
FIG. 1 is a cut away perspective in partial section of a first preferred embodiment of the invention.
Figure 2:
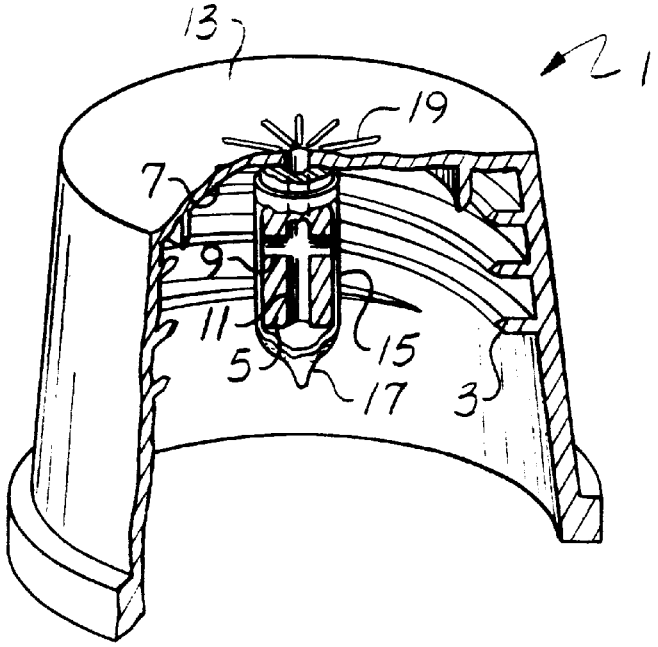
FIG. 2 is a cut away perspective in partial section of a second embodiment of the invention.

As best seen in FIG. 1, a preferred closure for a threaded container is provided by a plastic closure 1 defining a series of internal threads 3. An integral, molded tubular stem 5 is defined along an interior surface 7 of closure 1. Stem 5 is porous in that it defines a lateral passage 9 which is in communication along either passage end with an edge of stem 5. Passage 9 is in further communication with a second passage 11, passage 11 being defined along an axis of stem 5 and in further communication with an exterior surface 13 of closure 1. An irregular upper surface 19 is provide immediately surrounding the upper closure aperture associated with passage 11. Surface 19, is preferably stippled or features a raised surface pattern or other surface design which prevents a sticker or other decal from physically sealing the aperture region of passage 11.

A membrane sleeve 15 of PTFE surrounds an exterior surface of stem 5. Preferably, sleeve 15 is inserted over stem 5 where the inner diameter of sleeve 15 slightly exceeds the outer diameter of stem 5. Stem 5 provides a mechanical support for sleeve 15. The tight fit insures the membrane is held in position and also prevents the migration of fluids along the stem/membrane interface. Stem 5 and sleeve 15 collectively define the closure vent.

As seen in FIG. 1, the membrane covers the stem apertures defined by passage 9. The PTFE material for membrane sleeve 15 is a oleophobic/hydrophobic material extrudable into a seamless tube of desired diameter which possess the desired gas permeability properties while preventing the passage of fluids. One such supplier of this material is W.L. Gore & Co. (Putzbrunn, Germany). The sleeve material thickness can be varied across a rather broad range. At present, a thickness ranging between 0.5–1.0 mm has been found useful in that the material is easier to handle. However, thinner material stocks will perform the venting function as would a PTFE layer carried on a gas permeable support backing.

An additional embodiment (not pictured) could be provided by wrapping support stem 5 with one or more layers of a much thinner membrane material. Alternatively, a portion of stem 5 could be supplied as a snap-in component which is prewrapped or equipped with the PTFE membrane layer.

The above embodiments are well suited for containers housing extremely viscous fluids such as some water soluble surfactants and detergents. Typical flat vents are easily blocked by a layer of viscous material. Resulting pressure buildup within the container may actually trap the viscous fluids against the membrane surface, rendering the vent inoperative. The position and columnar shape of stem 5, promotes the collection and removal of fluids by gravity. The surface properties of the membrane tend to further repel the viscous fluid. As a result of the clearing action, the vent becomes operational even after an internal pressure has accumulated.

As seen in figure two, an alternative embodiment is illustrated in which the membrane sleeve 15 has a crimped end 17. Providing a crimped, sealed end allows axial passage 11 to extend the length of stem 5. Further, the crimped end may provide improved handling properties for the mechanical manipulation of the membrane material, such material having a low coefficient of friction and therefore is difficult to manipulate.

Figure 3:
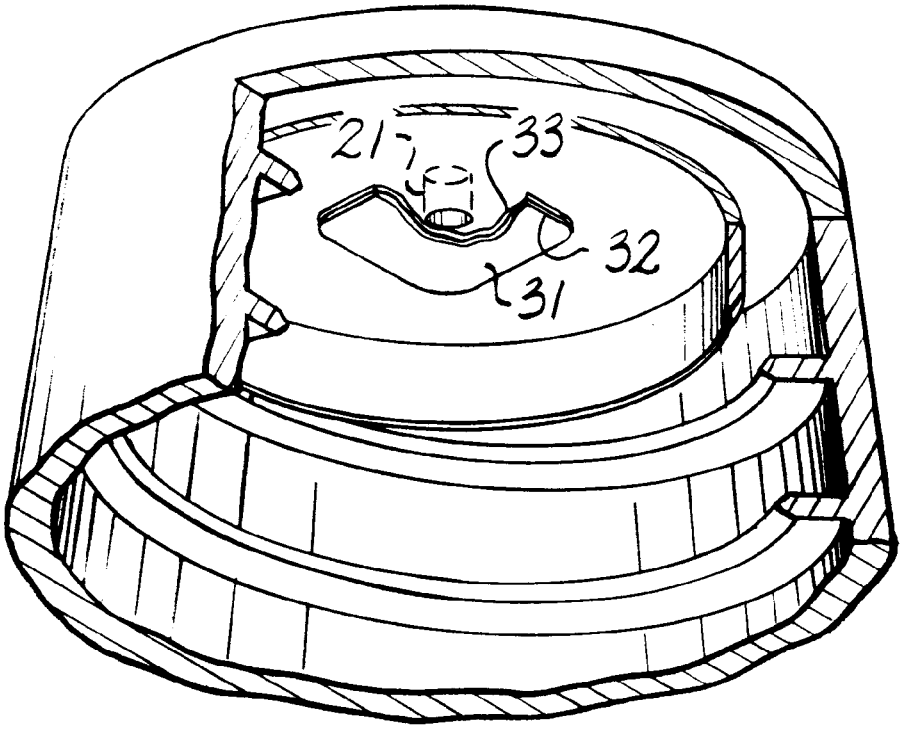
FIG. 3 is a cut away perspective in partial section of a third embodiment of the invention.

For less viscous contents, an additional embodiment is seen in reference to FIG. 3 in which an aperture 21 is defined through the closure top. A vent 32 comprising a barrier layer of PTFE 31 carried on a polyester support backing 33 is affixed in a permanent, liquid-tight seal covering the passage 21 opening of the inner cap. One source of the support-backed material is W.L. Gore & Co. (Putzbrunn, Germany).

The cap aperture diameter can vary in size. Effective results have been obtained with a diameter of less than 1 mm though any size opening sufficient to allow pressure to be released through the vent will suffice.

A preferred method of attaching the vent is through sonic welding. The support backing 33 can be of polyester or any of a wide variety of other compatible materials which offer mechanical support to and facilitate the handling of the PTFE membrane material. Polyester is one preferred material given its low cost, gas permeability, and its compatibility with the welding process.

Figure 4:
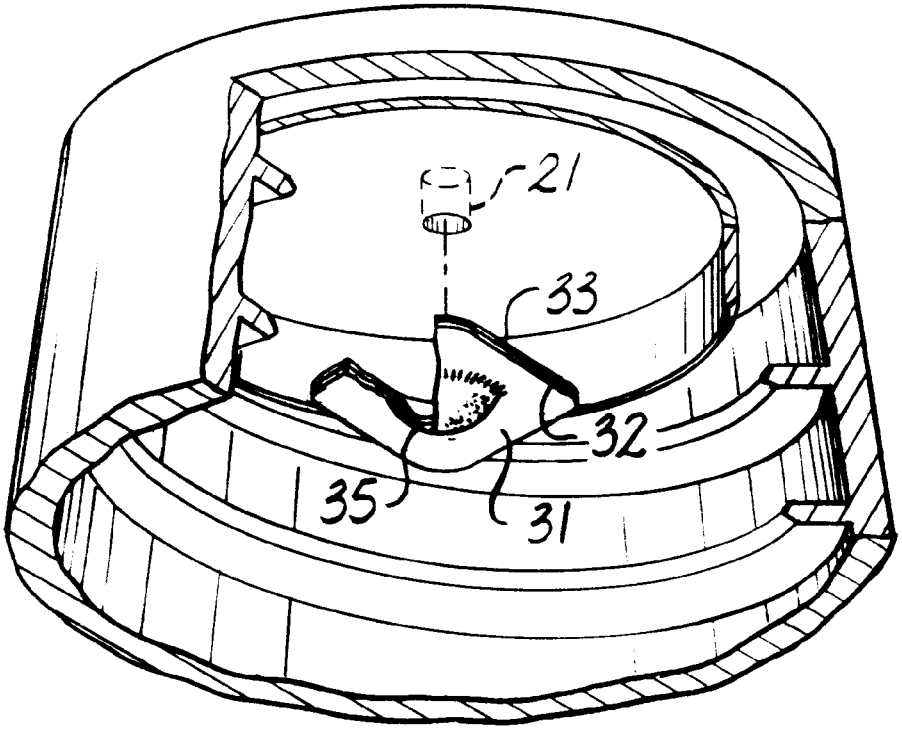
FIG. 4 is a cut away perspective in partial section of a fourth embodiment of the invention.

The support backing can be supplied as a fabric-based component of the vent as seen in FIGS. 3 and 4. However, other structural support materials may include any gas permeable material including a porous plastic. The support can vary in shape and thickness and may be integral with the closure or provided as a separate structure comprising the vent. Preferably, the support material is either conducive to sonic welding or other well known attachment methods suitable for the environmental conditions, or is integral to the cap and facilitates the attachment of the membrane barrier to the support, thereby providing the vent.

The vent size and shape is only limited by the mechanical difficulties of handling small pieces of the vent material as well as the physical properties, such as viscosity, of the material which requires venting. As previously mentioned, if a vent becomes occluded with a viscous material, pressure accumulations may render the vent inoperative as pressure traps the material against the vent, effectively sealing the vent and preventing pressure release.

A third embodiment of the instant invention address the competing problems of decreasing the size/cost of the PTFE containing vent versus a smaller vent size which is more prone to product blockage. As seen in FIG. 4, vent 32 is constructed with a support backing 33 and a PTFE barrier layer 31. A conical, raised bead 35 is formed in the vent so that a "drip point" is present to promote drainage of any fluids which may adhere to the vent. The conical bead is formed by placing the vent structure over a metal plate defining a conical shaped depression or mold. With the barrier surface facing the depression, a heated probe tip is used to form bead 35 within the mold. Ideally, the conical probe tip is maintained at a temperature which matches the softening temperature of the carrier material. Upon softening and forming the bead, the probe tip is removed. Upon slight cooling, the carrier material is set in the molded, pressed shape to form bead 35.

In accordance with this invention, it has been found that moderately viscous materials will slough off the bead and vent even under pressurized conditions. The size of the vent is again limited only by the viscosity of the container fluid and practical aspects of handling and sonic welding of the vent.

The presence of a backing material enables a reduced thickness membrane material to be used compared to the first two embodiments. The backing improves the structural strength and handling characteristics of the vent. The overall vent thickness is approximately 0.25 mm, the membrane portion having a thickness of about 0.025 mm.

The above described embodiments represent a significant advancement over known prior art vented cap structures. Extremely viscous materials, which heretofore precluded the use of vented closures, can now be dispensed in a vented container. The vent provides a geometry and position which promotes self-clearing of the vent.

It has also been found that a vent can be sonically welded as part of an integral cap structure. This ability permits reduced sized vents to be provided at a substantial cost savings over vent structures in which the membrane material is used as a liner. A sonically welded vent can also be formed into a conical shape to promote the clearing of the vent.

However, it is understood that many variations are apparent to one of ordinary skill in the art from a reading of the above specification and such variations are within the spirit and scope of the instant invention as defined by the following appended claims.

That which is claimed:

1. A closure comprising:

a cap having an inner-threaded skirt and a top, said top further defining a bore traversing said top;

a stem extending from a flat inner-surface of said top, said stem defining an axial passage along at least a portion of its length and said axial passage in communication with said bore, said stem further defining a lateral passage traversing said stem and in communication with said axial passage;

a sleeve carried by said stem, said sleeve covering said lateral passage stem openings and providing a semi-permeable barrier to said passage wherein said stem and said sleeve facilitate the removal of closure contents from the proximity of said lateral passage.

2. The closure according to claim 1 wherein said cap defines an irregular surface pattern in proximity to said bore.

3. The closure according to claim 1 wherein said cap and said stem are of unitary construction.

4. The closure according to claim 1 wherein said axial bore extends a length of said stem.

5. The closure according to claim 4 wherein said sleeve further defines a closed end adjacent a free end of said stem.

6. The closure according to claim 1 wherein said sleeve is carried by said stem in a liquid-tight manner.

7. A gas permeable liquid impermeable closure comprising:

a cap defining a top and a skirt and having an interior volume, said top having an inner and outer surface, said top further defining an aperture traversing said top;

a rigid vent attached to said inner surface and in communication with said aperture, said vent further comprising a sheet material comprising a rigid support layer overlapping said aperture on a first vent side and carrying a semi-permeable membrane sheet on a second vent side, said membrane sheet defining a tapered drainage surface relative to said inner cap surface and opposite said aperture, the entire tapered drainage surface being exposed to the interior volume of said cap.

8. The closure according to claim 7 wherein said vent occupies a surface area of said inner cap surface which is substantially less than the surface area defined by said inner surface of said top.

9. The closure according to claim 7 wherein said vent is substantially flush with said inner surface of said top.

10. The closure according to claim 7 wherein said tapered drainage surface further defines a conical surface.

11. A process of venting excess pressure from a container comprising the steps of:

providing a closure for said container, said closure defining an aperture permitting communication between an interior and an exterior of said container;

providing a vent comprising a gas permeable sheet barrier layer of PTFE and a rigid support layer, said barrier layer permitting the passage of gas molecules through said vent and restricting the passage of liquid molecules, the entire gas permeable barrier layer being exposed to the interior volume of said container;

positioning said vent within an interior of said closure and in communication with said aperture, said barrier layer further providing a tapered drainage surface relative to a flat inner closure surface and in open communication with a volume of said cap;

wherein, when said container with said closure is in a normal storage position, said tapered drainage surface facilitates the removal of fluid materials carried on said vent and said support layer maintains the shape of said barrier layer under pressurized conditions.

12. A closure comprising:

a cap having a top and a skirt and an interior volume, the top having an inner surface and an outer surface, said top further defining an aperture traversing said top and in communication with said interior volume;

a vent in communication with said aperture and comprising an outer layer of a hydrophobic semi-permeable membrane material, said outer layer in direct and open communication with said interior volume of said cap and further providing a drainage surface which projects away from said cap inner surface; and, said vent also comprising a backing positioned between said cap inner surface and said membrane, said backing adapted for maintaining the drainage surface shape of said membrane under conditions of pressure differentials relative to said inner and said outer membrane material.

13. The closure according to claim 12, wherein said vent is attached to said inner surface of said top at an attachment point, said attachment point defining a first surface area substantially less than a second surface area defined by said inner surface of said top.

14. The closure according to claim 12 wherein said backing defines a fabric layer.

15. The closure according to claim 14 wherein said vent backing comprises a gas permeable fabric layer.

16. The closure according to claim 12 wherein said backing is gas permeable and comprises a porous plastic.

17. The closure according to claim 16 wherein said plastic backing further comprises a stem carried by an inner-surface of said top, said stem defining an axial passage along at least a portion of its length and said axial passage in communication with said aperture, said stem further defining a lateral passage traversing said stem and in communication with said axial passage.

* * * * *